US011286768B2

(12) United States Patent
Hazel

(10) Patent No.: US 11,286,768 B2
(45) Date of Patent: Mar. 29, 2022

(54) DOWNHOLE PLUG AND ABANDONMENT SYSTEM

(71) Applicant: WELLTEC A/S, Allerød (DK)

(72) Inventor: Paul Hazel, Aberdeen (GB)

(73) Assignee: WELLTEC A/S, Allerød (DK)

( * ) Notice: Subject to any disclaimer, the term of this patent is extended or adjusted under 35 U.S.C. 154(b) by 33 days.

(21) Appl. No.: 15/925,917

(22) Filed: Mar. 20, 2018

(65) Prior Publication Data

US 2018/0274356 A1 Sep. 27, 2018

(30) Foreign Application Priority Data

Mar. 21, 2017 (EP) ..... 17162047

(51) Int. Cl.
*E21B 47/06* (2012.01)
*E21B 47/12* (2012.01)
(Continued)

(52) U.S. Cl.
CPC ..... *E21B 47/06* (2013.01); *E21B 33/13* (2013.01); *E21B 36/00* (2013.01); *E21B 36/02* (2013.01);
(Continued)

(58) Field of Classification Search
CPC ..... E21B 33/13; E21B 36/00; E21B 36/02; E21B 47/0003; E21B 47/0005;
(Continued)

(56) References Cited

U.S. PATENT DOCUMENTS 6,443,228 B1 * 9/2002 Aronstam ..... E21B 47/01 166/250.11
6,538,576 B1 * 3/2003 Schultz ..... E21B 41/0085 340/854.6
(Continued)

FOREIGN PATENT DOCUMENTS

EP 2 157 279 A1 2/2010
EP 2 599 955 6/2013
(Continued)

OTHER PUBLICATIONS

Extended Search Report for EP 17162047.9, dated Sep. 17, 2013, 9 pages.
(Continued)

*Primary Examiner* — Christopher J Sebesta
(74) *Attorney, Agent, or Firm* — Nixon & Vanderhye P.C.

(57) ABSTRACT

The present invention relates to a downhole plug and abandonment system comprising a well tubular structure having an inside and a wall and being arranged in a borehole, a first plug arranged in the well tubular structure for sealing off a lower part of the well tubular structure, a second plug arranged in the well tubular structure at a distance and above the first plug isolating a confined space having a space pressure between the first plug and the second plug, wherein an abandonment device is arranged in the confined space, the abandonment device comprising: a unit configured to increase the space pressure, a sensor configured to measure a temperature and/or a pressure in the confined space, and a device communication module configured to receive an input from the sensor and to communicate signals from the abandonment device. Furthermore, the present invention relates to a downhole plug and abandonment method.

16 Claims, 5 Drawing Sheets

Figure 1:
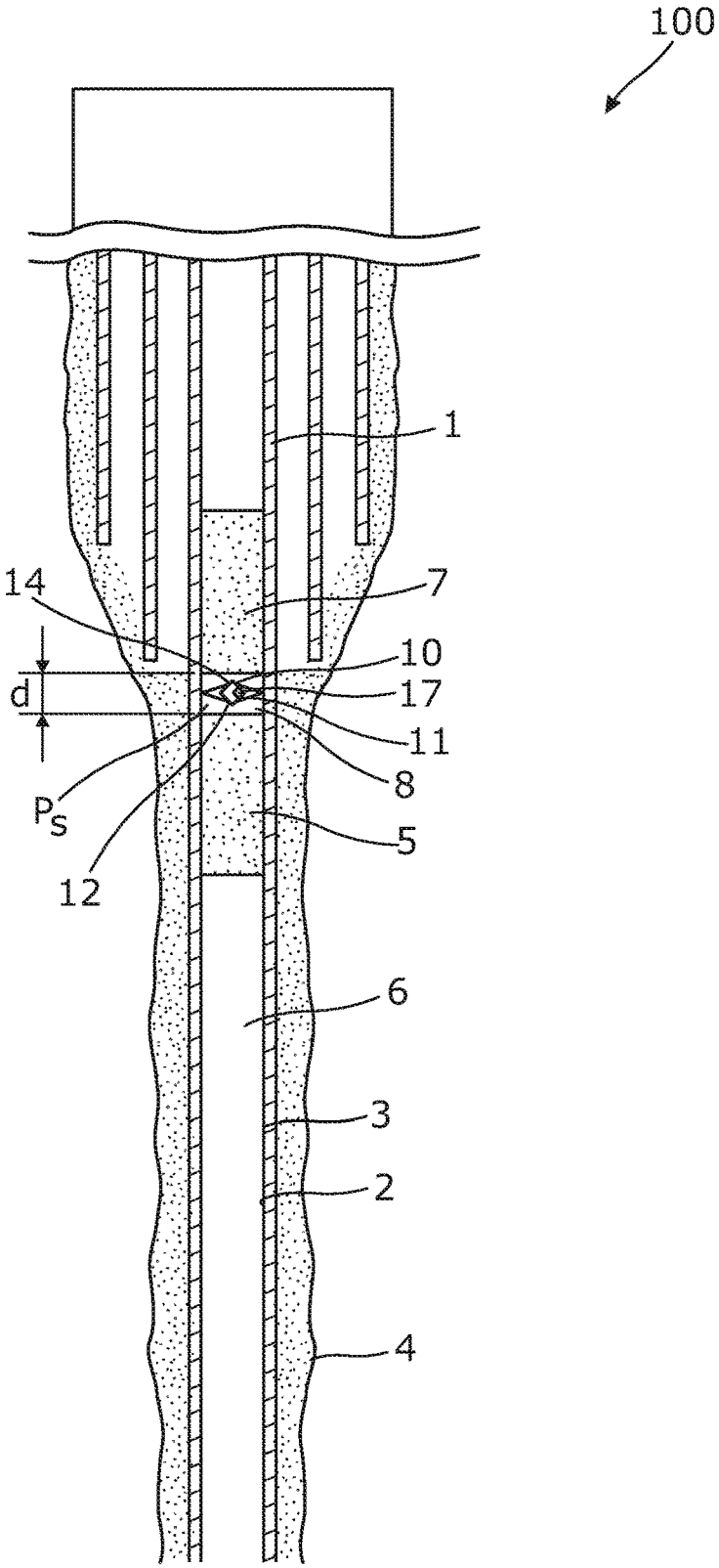

(51) Int. Cl.

| | |
|---|---|
| ***E21B 47/003*** | (2012.01) |
| ***E21B 47/005*** | (2012.01) |
| ***E21B 47/07*** | (2012.01) |
| ***E21B 33/13*** | (2006.01) |
| ***E21B 36/00*** | (2006.01) |
| ***E21B 36/02*** | (2006.01) |

(52) U.S. Cl.
CPC ..... *E21B 47/003* (2020.05); *E21B 47/005* (2020.05); *E21B 47/07* (2020.05); *E21B 47/12* (2013.01)

(58) Field of Classification Search
CPC ..... E21B 47/06; E21B 47/065; E21B 47/12; E21B 47/003; E21B 47/005; E21B 47/07
See application file for complete search history.

(56) References Cited

U.S. PATENT DOCUMENTS

| | | | | |
|---|---|---|---|---|
| 2002/0194906 | A1* | 12/2002 | Goodwin | E21B 49/08 73/152.46 |
| 2010/0314562 | A1* | 12/2010 | Bisset | E21B 34/06 251/12 |
| 2011/0017448 | A1* | 1/2011 | Pipchuk | E21B 19/22 166/250.07 |
| 2011/0192592 | A1* | 8/2011 | Roddy | E21B 47/01 166/250.01 |
| 2013/0133883 | A1 | 5/2013 | Hill, Jr. | |
| 2013/0299165 | A1* | 11/2013 | Crow | E21B 33/12 166/250.08 |
| 2013/0304384 | A1* | 11/2013 | Rabinovich | E21B 47/026 702/6 |
| 2013/0342210 | A1* | 12/2013 | Stokely | G01R 33/26 324/346 |
| 2014/0034301 | A1 | 2/2014 | Leblanc | |
| 2015/0112597 | A1* | 4/2015 | Laing | E21B 47/042 702/9 |
| 2017/0096871 | A1* | 4/2017 | Hoefler | E21B 47/00 |
| 2018/0094519 | A1* | 4/2018 | Stephens | E21B 47/0001 |
| 2018/0305993 | A1* | 10/2018 | Perkins | E21B 23/00 |
| 2020/0080415 | A1* | 3/2020 | Behjat | E21B 33/14 |

FOREIGN PATENT DOCUMENTS

| | | |
|---|---|---|
| WO | WO 1999/060250 | 11/1999 |
| WO | WO 2018/078356 A1 | 5/2018 |
| WO | WO 2018/106122 A1 | 6/2018 |

OTHER PUBLICATIONS

International Preliminary Report on Patentability dated Oct. 3, 2019 in International Application No. PCT/EP2018/056942, 10 pages.
Examination Report No. 2 for Standard Patent Application dated Sep. 24, 2020 in Australian Application No. 2018240337, 3 pages.

* cited by examiner

DOWNHOLE PLUG AND ABANDONMENT SYSTEM

This application claims priority to EP Patent Application No. 17162047.9 filed Mar. 21, 2017, the entire content of which is hereby incorporated by reference.

The present invention relates to a downhole plug and abandonment system and to a downhole plug and abandonment method.

When a well becomes less productive, and all attempts to improve the production of hydrocarbons from a reservoir have failed, the unproductive part of the well, if not the whole well, is plugged and abandoned. The well is often abandoned by setting a cement plug in the casing, and subsequently the volume in the casing above the cement plug is pressurised to verify that the plug is able to withstand pressure and thus to prevent a blowout. However, a blowout is a very high pressure coming from below the plug, but such test circumstance cannot be provided as the volume in the casing below the plug is sealed off and therefore cannot be pressurised, and thus the pressure test from above the plug must thus suffice in the known plug and abandonment systems. However, there is a risk that the cement plug is not made properly and that gaps or non-cemented areas occur. And should such gaps or non-cemented areas occur near the bottom of the plug, this could jeopardise the cement plug when pressure comes from below.

It is an object of the present invention to wholly or partly overcome the above disadvantages and drawbacks of the prior art. More specifically, it is an object to provide an improved plug and abandonment system capable of ensuring that the plug can withstand pressure from a blowout, and thus increase the safety of abandoned wells.

The above objects, together with numerous other objects, advantages and features, which will become evident from the below description, are accomplished by a solution in accordance with the present invention by a downhole plug and abandonment system comprising:

- a well tubular structure having an inside and a wall and being arranged in a borehole,
- a first plug arranged in the well tubular structure for sealing off a lower part of the well tubular structure,
- a second plug arranged in the well tubular structure at a distance and above the first plug isolating a confined space having a space pressure between the first plug and the second plug, wherein a wireless abandonment device is arranged in the confined space, the abandonment device comprising:

- a unit configured to increase the space pressure,
- a sensor configured to measure a temperature and/or a pressure in the confined space, and
- a device communication module configured to receive an input from the sensor and to communicate signals from the abandonment device.

By having an abandonment device in the confined space under the second plug, the second plug can be pressure tested from below. And thus the second plug can be tested in the circumstance which it is to prevent, namely preventing a blowout, from below the plug. In prior art solutions, the plug is merely tested from above by performing a pressure test by pressurising the inside of the well tubular structure above the plug which is not the same as testing the plug with an increased pressure from below.

Moreover, the second plug may have no through-bore for a cable, a conductor, an optic line or control line.

Further, the wireless abandonment device may be self-powered, e.g. by a battery or a fuel cell.

The downhole plug and abandonment system according to the present invention may further comprise a downhole tool arranged in the well tubular structure above the second plug, the downhole tool comprising a tool communication module for receiving signals from the abandonment device.

Also, the communication modules may send or receive data or signals by means of electromagnetic radiation or acoustic or mechanical vibrations.

Moreover, the communication module may comprise a transducer.

Furthermore, the transducer may be a piezoelectric element.

In addition, the downhole tool may comprise a tool sensor, such as a pressure sensor and/or a temperature sensor.

Further, the downhole tool may be a wireline tool.

The first plug and the second plug may be arranged in the same well tubular structure.

Also, the downhole tool may be configured to communicate with a control unit at surface.

Additionally, the unit may comprise a heating element for increasing the temperature in the confined space so that the pressure increases.

Such heating element may be a heater.

Furthermore, the unit may comprise a power charge for increasing the temperature in the confined space so that the pressure increases.

Said power charge may be a slow burning charge.

Further, said power charge may be configured to generate a gas pressure and/or heat.

Moreover, the unit may comprise a gas canister having a gas for increasing the pressure in the confined space when the gas is released in the confined space.

Also, the unit may comprise a pump and a fluid reservoir having a fluid.

Furthermore, the unit may comprise an accumulator.

The abandonment device may comprise a power pack such as a battery.

Further, the abandonment device may comprise a timer.

In addition, the abandonment device may comprise a volume determination arrangement configured to measure characteristics of the confined space for determining a volume of the confined space.

The first plug and the second plug may be made of cement.

Moreover, the cement may comprise a plurality of sensor units configured to form a mesh network.

Said mesh network may be a self-healing mesh network.

At least a plurality of the plurality of sensor units may be provided with a detector for detecting cement characteristics of the cement.

Also, the abandonment device may comprise an anchoring arrangement configured to anchor the abandonment device to the wall of the well tubular structure between the first plug and the second plug.

Additionally, the confined space may comprise a fluid.

The present invention also relates to a downhole plug and abandonment method comprising:

- arranging a first plug in a well tubular structure for sealing off a lower part of the well tubular structure,
- arranging an abandonment device above the first plug,
- arranging a second plug in the well tubular structure at a distance and above the first plug isolating a confined space having a space pressure between the first plug and the second plug, the abandonment device being arranged in the confined space, increasing the pressure in the confined area by means of the abandonment device, measuring a temperature and/or a pressure of the confined area, and communicating the measurement and/or at least a signal representing the measurement to above the second plug.

The downhole plug and abandonment method according to the present invention may further comprise arranging a downhole tool above the second plug configured to receive the measurement and/or the signal representing the measurement.

Further, the downhole plug and abandonment method according to the present invention may further comprise receiving the measurement and/or the signal representing the measurement by means of a tool communication module of the downhole tool from the abandonment device by means of a mesh network in the second plug.

The downhole plug and abandonment method according to the present invention may further comprise receiving the measurement and/or the signal representing the measurement by means of a tool communication module of the downhole tool from the abandonment device by means of electromagnetic radiation or acoustic or mechanical vibrations.

It should be noted that within this specification, the term "mesh network" should be interpreted as a network of which each associated sensor forms a network node being configured to relay data for the network. All network sensors thus cooperate in the distribution of data in the network. In a mesh network within the context of this specification, data transfer is accomplished by routing data between the sensors until the data reaches its destination. The data path is not constant, but re-routed if any existing sensors are unavailable.

Figure 2:
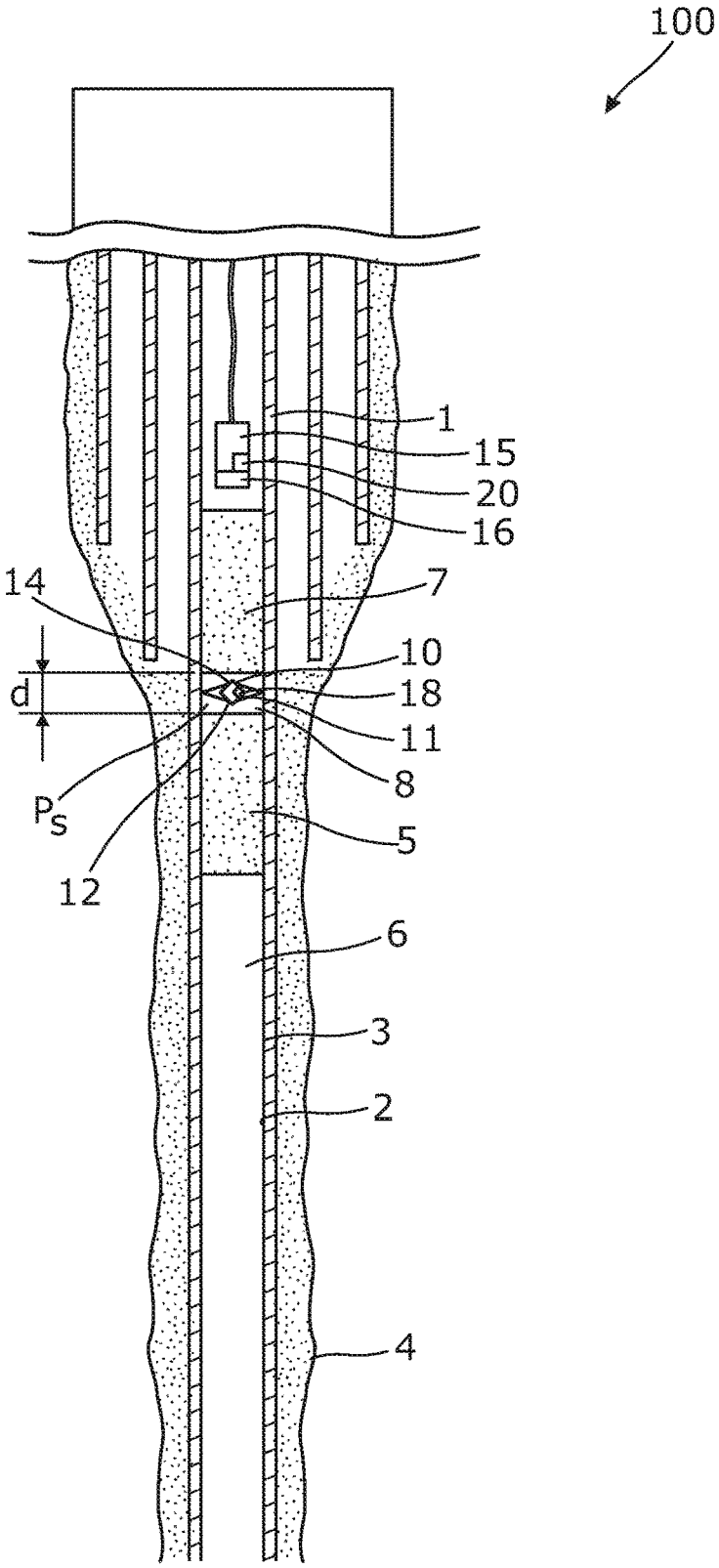
Figure 3:
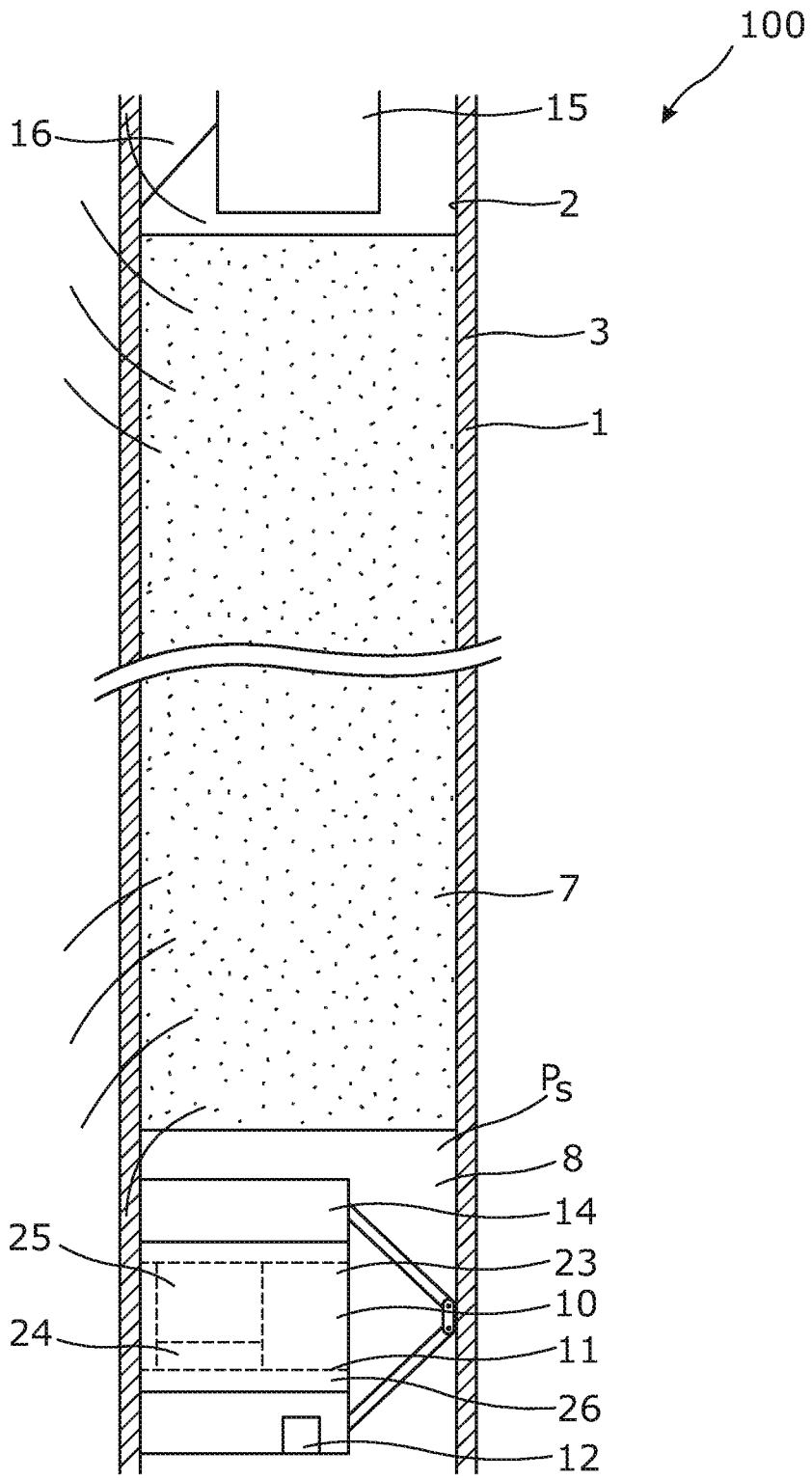
Figure 4:
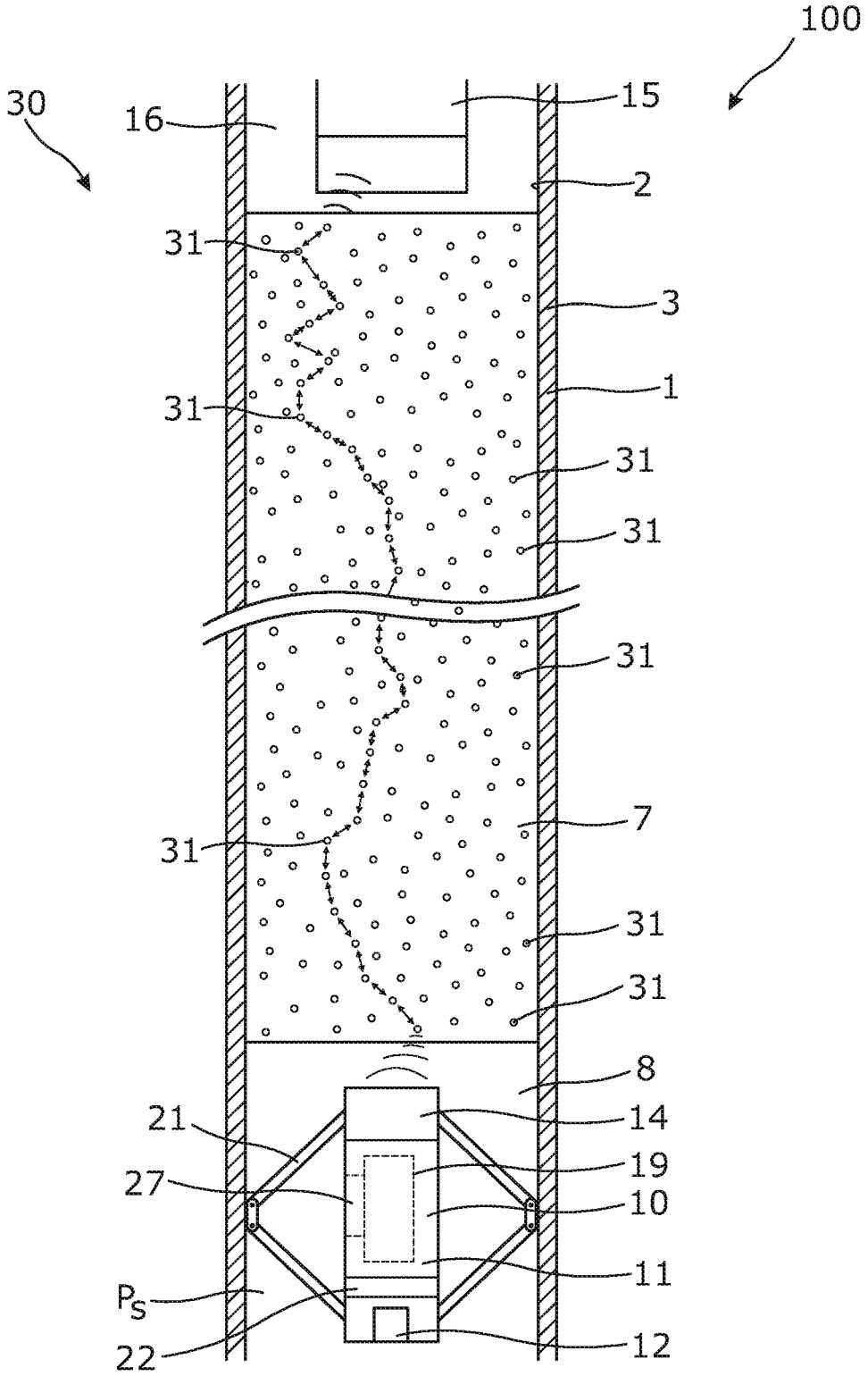
Figure 5:
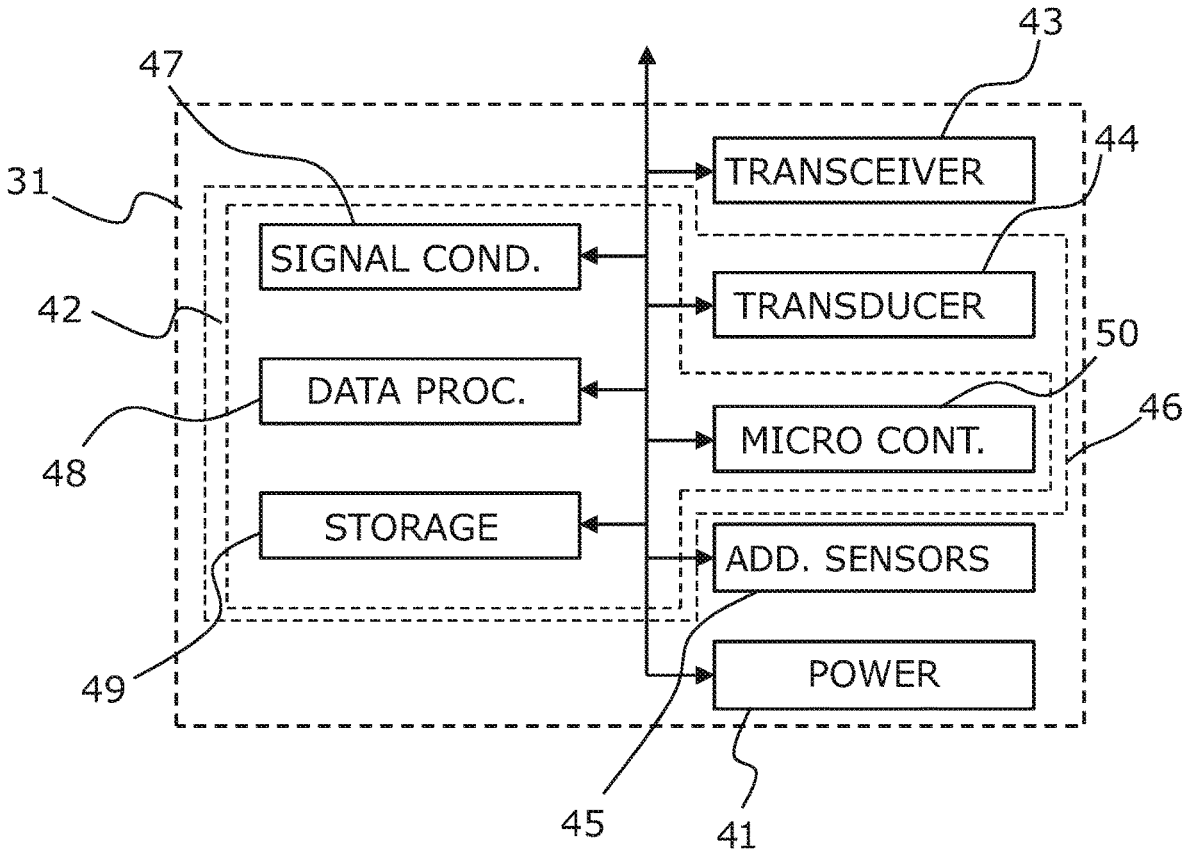

The invention and its many advantages will be described in more detail below with reference to the accompanying schematic drawings, which for the purpose of illustration show some non-limiting embodiments and in which FIG. 1 shows a partly cross-sectional view of a downhole plug and abandonment system, FIG. 2 shows a partly cross-sectional view of another downhole plug and abandonment system having a downhole tool, FIG. 3 shows a partly cross-sectional view of an enlarged part of yet another downhole plug and abandonment system, FIG. 4 shows a partly cross-sectional view of another downhole plug and abandonment system providing a mesh network, and FIG. 5 shows a diagram of a sensor unit.

All the figures are highly schematic and not necessarily to scale, and they show only those parts which are necessary in order to elucidate the invention, other parts being omitted or merely suggested.

DETAILED DESCRIPTION OF THE INVENTION

FIG. 1 shows a downhole plug and abandonment system 100 comprising a well tubular structure 1 having an inside 2 and a wall 3 and being arranged in a borehole 4 of a well. The downhole plug and abandonment system further comprises a first plug 5 arranged in the well tubular structure 1 for sealing off a lower part 6 of the well tubular structure, and a second plug 7 arranged in the well tubular structure 1 at a distance d and above the first plug 5 isolating a confined space 8 between the first plug and the second plug, where the confined space 8 has a space pressure $P_s$. An wireless abandonment device 10 is arranged in the confined space, and the abandonment device comprises a unit 11 configured to increase the space pressure, a sensor 12 configured to measure a temperature and/or a pressure in the confined space, and a device communication module 14 configured to receive an input from the sensor and to communicate signals from the abandonment device. By having an abandonment device in the confined space 8 under the second plug 7, the second plug can be pressure tested from below, and thus the second plug can be tested in the circumstance which it is to prevent, namely preventing a blowout from below the plug.

Prior art solutions have a constellation in which the plug is tested from above or in which the plug is penetrated by wires which induces a substantial risk since the plug is not pressure tight and significant leaks have been observed to occur. As the wires deteriorates over time due to the harsh environment and thus leak very quickly, the well is not safely plugged when using such wiring through the plug.

By having a wireless abandonment device 10 arranged in the confined space 8, the plug above the wireless abandonment device 10 has no through-bore and is thus not penetrated by any conductors, cables etc., and the plug is thus significantly safer over time which is very important when abandoning the well, or that part of the well, for many years, if not entirely.

After the second plug 7 is set, the unit 11 increases the pressure or the temperature (and thereby the pressure), and the sensor 12 measures the pressure and/or the temperature to detect if the confined space 8 maintains the pressure before a natural decrease due to transmission of heat from the confined space to its surroundings over time. In this way, the second plug 7 is pressure tested from below, but the first plug 5 is at the same time tested from above. Once the sensor 12 has detected the pressure or temperature, the communication module sends the measured data to some device above the second plug 7 or just sends a signal as a representation of the measured temperature or pressure.

In FIG. 2, the downhole plug and abandonment system 100 further comprises a downhole tool 15 arranged in the well tubular structure 1 above the second plug 7, and the downhole tool comprises a tool communication module 16 for receiving at least one signal from the abandonment device 10. The signal may be an indication that a pressure increase has occurred in the confined space 8, i.e. that the unit of the abandonment device 10 has increased the pressure. The downhole tool 15 comprises a pressure sensor and/or a temperature sensor 20, and by measuring the pressure and/or temperature above the second plug 7 during the pressure increase in the confined space, a leak can be detected by the sensor 20 or a significant seal of the plug can be verified by the sensor 20. Thus, the sensor 12 of the abandonment device 10 measures the temperature/pressure of the fluid in the confined space to verify that a pressure increase has occurred, and the communication module 14 communicates to the tool 15 that a pressure increase has occurred. The sensor 20 of the tool 15 measures the temperature/pressure just above the second plug 7 during the time period of the pressure increase in the confined space, and if no temperature/pressure increase is measured by the tool sensor 20, then the first and second plugs 5,7 provide a seal which is sufficient for abandoning the well or drilling the well in another direction above the second plug 7.

As can be seen in FIG. 2, the downhole tool 15 is a wireline tool, and the verification data or measured data can be communicated to the surface or the top of the well through the wireline. The wireline may also be some other kind of line such as optical line etc. The downhole tool 15 is therefore configured to communicate with a control unit (not shown) at surface or at the top of the well. The communication modules of the tool 15 and the abandonment device 10 may send or receive data or signals by means of electromagnetic radiation or acoustic or mechanical vibrations. In one embodiment, the communication module(s) comprises/comprise a transducer and the transducer may be a piezoelectric element sending and/or receiving mechanical vibrations through the well tubular structure or through its surroundings.

In FIG. 3, the communication module 16 of the downhole tool 15 and the communication module 14 of the abandonment device 10 abut the wall of the well tubular metal structure and transmit signals there between by means of acoustic or mechanical vibrations through the wall of the well tubular metal structure.

In FIG. 1, the first plug 5 and the second plug 7 are arranged in the same well tubular structure and the plugs are primarily of cement. In FIG. 4, the cement comprises sensor units 31 providing a mesh network 30 (indicated by the arrows), which may be a self-healing mesh network. In this way, the downhole tool and the abandonment device 10 are able to communicate "through" the cement via the sensor units 31 of the mesh network 30.

By having a plurality of sensor units distributed in the cement, a mesh network can be formed by the sensor units, and each sensor unit can send information to an adjacent sensor unit which again sends the received information from the lower sensor unit. This is repeated until the information reaches the surface.

In order to increase the pressure in the confined space 8, the unit 11 comprises a heating element 17, as shown in FIG. 1, for increasing the temperature in the confined space and thus increasing the pressure. The heating element may be a heater, such as an electrical heating element. In FIG. 2, the unit 11 comprises a power charge 18 for increasing the temperature in the confined space 8 and thus increasing the pressure in the confined space 8. The power charge also increases the pressure as the solid is transformed into gas. The power charge may be a slow burning charge or similar charge providing a combustion reaction. The power charge may be a composition which when mixed provides a chemical reaction or decomposition. The power charge may thus be configured to generate a gas pressure and/or heat. In FIG. 4, the unit 11 comprises a gas canister 19 having a gas for increasing the pressure in the confined space when the gas is released in the confined space. As can be seen in FIG. 3, the unit 11 comprises a pump 23 and a motor 24 for driving the pump. The unit further comprises a fluid reservoir 25 having a fluid, e.g. an accumulator. In order to power the unit and other parts of the abandonment device, the abandonment device 10 comprises a power pack 26, such as a battery. The abandonment device 10 may also comprise a timer 27, as shown in FIG. 4, so that the abandonment device does not need a signal to activate the unit 11 to increase the pressure in the confined space but instead is activated after a certain elapsed time controlled by the timer.

By having a wireless abandonment device in the confined space 8 which is self-powered, e.g. by a battery or a fuel cell, the wireless abandonment device is not dependent on receiving power from above the second plug either by wireline through the plug or through the well tubular metal structure, e.g. by means of lines therein/therethrough.

In FIG. 4, the abandonment device 10 comprises a volume determination arrangement 22 configured to measure characteristics of the confined space 8 for determining a volume of the confined space. If the plugs are set in a more imprecise manner, the volume determination arrangement 22 is used to determine the volume of the confined space which may be used to give a more precise determination of the pressure in the confined space during the increase of the pressure.

Each sensor unit 31 is positioned arbitrarily in the flowable cement during the making of the plugs, and the distribution of sensor units 31 is thus random, though distributed into the cement in an evenly manner so that the sensor units 31 are more or less evenly distributed in the flowable cement, as shown in FIG. 4. It should be noted that only some of the sensor units 31 have been assigned the reference numeral "31" in FIG. 4; however, all circular elements shown in this figure represents a sensor unit 31.

As will be explained in the following, this is realised by configuring the sensor units 31 to establish a physically distributed independent and localised sensing network, preferably with peer-to-peer communication architecture. As will be understood from the following description, the mesh network being established by the sensor units 31 as a self-healing mesh network will automatically provide for a reliable and self-healing data path even though at least some of the sensor units 31 are out of range from the final destination, i.e. the data collection provided at the surface level. All sensor units 31 are preferably identical, although provided with a unique ID. As shown in FIG. 5, each sensor unit 31 is provided with a number of components configured to provide various functionality to the sensor unit 31. Each sensor unit 31 includes a power supply 41, a digital processing unit 42, a transceiver 43, a transducer 44, and optionally a sensor module 45 comprising additional sensors. The sensor module 45 may e.g. comprise a temperature sensor and/or a pressure sensor. The transducer 44, together with the digital processing unit 42, form a detector 46 for determining cement characteristics. In particular, the cement characteristics include acoustic impedance, whereby it is possible to determine the cement integrity by analysing the acoustic impedance and thus determine if the cement plug is performed in a satisfactory manner without any pockets without cement. The detector 46 can for example be used together with the digital processing unit 42 to form a detecting unit for determining position data of the sensor unit 31.

Each one of said sensor units 31 of the mesh network is positioned in the cement, and at least one of said sensor units may be provided with a detector for detecting cement characteristics of the cement in the annulus. If a sensor unit detects cement all the way around itself, the sensor unit may send the measurement or only an "Okay" signal to the adjacent sensor unit, and if a sensor unit detects an uncemented area, the sensor unit may send such measurement or only a "non-okay" signal in order to simplify the data to be sent to the surface. In this way, also the cement of the plug can be verified so that if the second plug is not good enough, more cement can be pured down before preforming the pressure testing.

The power supply 41 is configured to supply power to the other components 42-45 of the sensor unit 31, either by means of an internal power storage, such as one or more batteries, or by converting energy of the surrounding cement to electrical energy. The digital processing unit 42 comprises a signal conditioning module 47, a data processing module 48, a data storage module 49 and a micro controller 50. The digital processing unit 42 is configured to control operation of the entire sensor unit 31, as well as temporarily storing sensed data in the memory of the data storage module 49. The transceiver 43 is configured to provide wireless communication with transceivers of adjacent sensor units 31. For this, the transceiver 43 comprises a radio communication module and an antenna. The radio communication module may be configured to communicate according to well-established radio protocols, e.g. IEEE 801.1aq (Shortest Path Bridging), IEEE 802.15.4 (ZigBee) etc. The transducer 44 is configured to transmit and receive sonar signals/pulses in order to determine characteristics of the surrounding cement.

In FIG. 4, the abandonment device 10 comprises an anchoring arrangement 21 configured to anchor the abandonment device 10 to the wall of the well tubular structure 1 between the first plug 5 and the second plug 7. The anchoring arrangement may have any kind of configuration capable of anchoring the abandonment device 10.

The present invention also relates to a downhole plug and abandonment method. According to this method, a first plug 5 is arranged in a well tubular structure 1 for sealing off a lower part 6 of the well tubular structure 1. Then an abandonment device 10 is arranged above the first plug, and a second plug 7 is arranged in the well tubular structure at a distance and above the first plug isolating a confined space 8 having a space pressure between the first plug and the second plug, the abandonment device being arranged in the confined space. Subsequently, the pressure in the confined area is increased by means of the abandonment device, and a temperature and/or a pressure of the confined area are/is measured. At least a signal representing the measurement and/or the measurement is communicated to above the second plug.

Furthermore, in the downhole plug and abandonment method, a downhole tool 15 may be arranged above the second plug 7 configured to receive the measurement and/or the signal representing the measurement. Moreover, the measurement and/or the signal representing the measurement is received by means of a tool communication module 16 of the downhole tool from the abandonment device by means of a mesh network in the second plug. Further in this method, the measurement and/or the signal representing the measurement may be received by means of a tool communication module of the downhole tool from the abandonment device 10 by means of electromagnetic radiation or acoustic or mechanical vibrations.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole plug and abandonment system comprising:
- a well tubular structure having an inside and a wall and being arranged in a borehole,
- a first plug arranged in the well tubular structure for sealing off a lower part of the well tubular structure,
- a second plug arranged in the well tubular structure at a distance and above the first plug isolating a confined space having a space pressure extending from the first plug to the second plug,
- wherein a wireless abandonment device is arranged in the confined space, the abandonment device comprising:
- a unit configured to increase the space pressure below the second plug to a test pressure in the confined space, the test pressure in use being applied to the first plug and the second plug,
- a sensor configured to measure a temperature and/or a pressure in the confined space during application of the test pressure in the confined space and below the second plug to verify sealing of at least the second plug,
- a device communication module configured to receive an input from the sensor and to communicate signals from the abandonment device,
- wherein the unit comprises an electric heating element.

2. A downhole plug and abandonment system according to claim 1, wherein at least the second plug has no through-bore for a cable, a conductor, an optic line or control line.

3. A downhole plug and abandonment system according to claim 1, further comprising a downhole tool arranged in the well tubular structure above the second plug, the downhole tool comprising a tool communication module for receiving signals from the abandonment device.

4. A downhole plug and abandonment system according to claim 3, wherein the downhole tool comprises a pressure sensor and/or a temperature sensor.

5. A downhole plug and abandonment system according to claim 1, wherein the abandonment device comprises a volume determination arrangement configured to measure characteristics of the confined space for determining a volume of the confined space.

6. A downhole plug and abandonment system according to claim 1, wherein the first plug and the second plug are made of cement.

7. A downhole plug and abandonment system according to claim 6, wherein the cement comprises a plurality of sensor units configured to form a mesh network.

8. A downhole plug and abandonment system according to claim 7, wherein at least a plurality of the plurality of sensor units are provided with a detector for detecting cement characteristics of the cement.

9. A downhole plug and abandonment system according to claim 1, wherein the abandonment device comprises an anchoring arrangement configured to anchor the abandonment device to the wall of the well tubular structure between the first plug and the second plug.

10. A downhole plug and abandonment method comprising:
- arranging a first plug in a well tubular structure for sealing off a lower part of the well tubular structure,
- arranging an abandonment device above the first plug,
- arranging a second plug in the well tubular structure at a distance and above the first plug isolating a confined space having a space pressure extending from the first plug to the second plug, the abandonment device being arranged in the confined space, increasing the pressure to a test pressure in the confined area and below the second plug using an electric heating element of the abandonment device, the test pressure, in use, being applied to both the first plug and the second plug, measuring a temperature and/or a pressure of the confined area during application of the test pressure in the confined area and below the second plug to verify sealing of at least the second plug, and communicating the measurement and/or at least a signal representing the measurement to above the second plug.

11. A downhole plug and abandonment method according to claim 10, further comprising:

arranging a downhole tool above the second plug configured to receive the measurement and/or the signal representing the measurement.

12. A downhole plug and abandonment method according to claim 10, further comprising:

receiving the measurement and/or the signal representing the measurement by means of a tool communication module of the downhole tool from the abandonment device by means of a mesh network in the second plug.

13. A downhole plug and abandonment method according to claim 10, further comprising receiving the measurement and/or the signal representing the measurement by means of a tool communication module of the downhole tool from the abandonment device by means of electromagnetic radiation or acoustic or mechanical vibrations.

14. A downhole plug and abandonment system comprising:

a well tubular structure having an inside and a wall and being arranged in a borehole, a first plug arranged in the well tubular structure for sealing off a lower part of the well tubular structure, a second plug arranged in the well tubular structure at a distance and above the first plug isolating a confined space having a space pressure extending from the first plug to the second plug, wherein a wireless abandonment device is arranged in the confined space, the abandonment device comprising:

a unit configured to increase the space pressure below the second plug to a test pressure in the confined space, the test pressure in use being applied to the first plug and the second plug, a sensor configured to measure a temperature and/or a pressure in the confined space during application of the test pressure in the confined space and below the second plug to verify sealing of at least the second plug, a device communication module configured to receive an input from the sensor and to communicate signals from the abandonment device, wherein the unit comprises a power charge or a gas canister having a gas.

15. A downhole plug and abandonment system according to claim 14, wherein the unit comprises the power charge.

16. A downhole plug and abandonment system according to claim 14, wherein the unit comprises the gas canister having a gas.

* * * * *